US006210261B1

(12) United States Patent
Johnson

(10) Patent No.: US 6,210,261 B1
(45) Date of Patent: Apr. 3, 2001

(54) TOOL PROTECTIVE SHIELD

(75) Inventor: James E. Johnson, 617 Vinewood #B, Escondido, CA (US) 92029

(73) Assignees: James E. Johnson; Patrica L. Johnson, both of Escondido, CA (US)

( * ) Notice: Subject to any disclaimer, the term of this patent is extended or adjusted under 35 U.S.C. 154(b) by 0 days.

(21) Appl. No.: 09/435,114

(22) Filed: Nov. 5, 1999

Related U.S. Application Data

(60) Provisional application No. 60/108,534, filed on Nov. 16, 1998.

(51) Int. Cl.[7] ..... B24B 55/06
(52) U.S. Cl. ..... 451/451; 451/455; 451/457
(58) Field of Search ..... 451/451, 456, 451/454, 455, 457

(56) References Cited

U.S. PATENT DOCUMENTS

| | | | | |
|---|---|---|---|---|
| 1,021,065 | * | 3/1912 | Neil | 451/451 |
| 2,429,356 | * | 10/1947 | Hicks | 451/451 |
| 2,875,642 | * | 3/1959 | Colburn | 451/451 |
| 3,019,751 | * | 2/1962 | Fichera | 451/451 |
| 3,126,021 | * | 3/1964 | May | 451/451 |
| 4,200,417 | * | 4/1980 | Hager et al. | 451/456 |
| 4,440,045 | * | 4/1984 | Aksamit | 451/451 |
| 5,220,753 | * | 6/1993 | Whitman | 451/456 |

* cited by examiner

*Primary Examiner*—Eileen P. Morgan

(57) ABSTRACT

The present invention, a tool safety shield, comprises a clip with at least one shield. The clip further comprises vent ribs. The shield extension further comprises a vacuum port. Both one piece and two piece embodiments are disclosed. The tool safety shield is attachable to a tool or to an adapter from the tool to the tool safety shield.

5 Claims, 13 Drawing Sheets

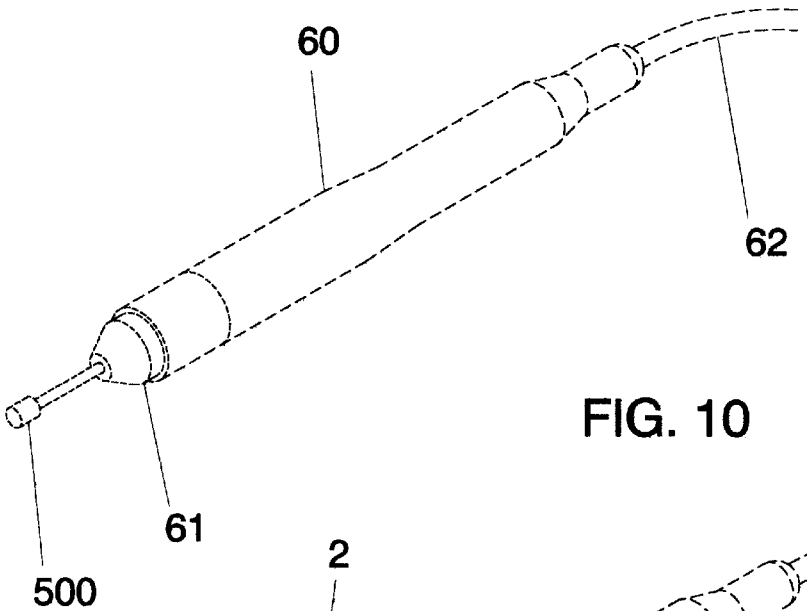
FIG. 10
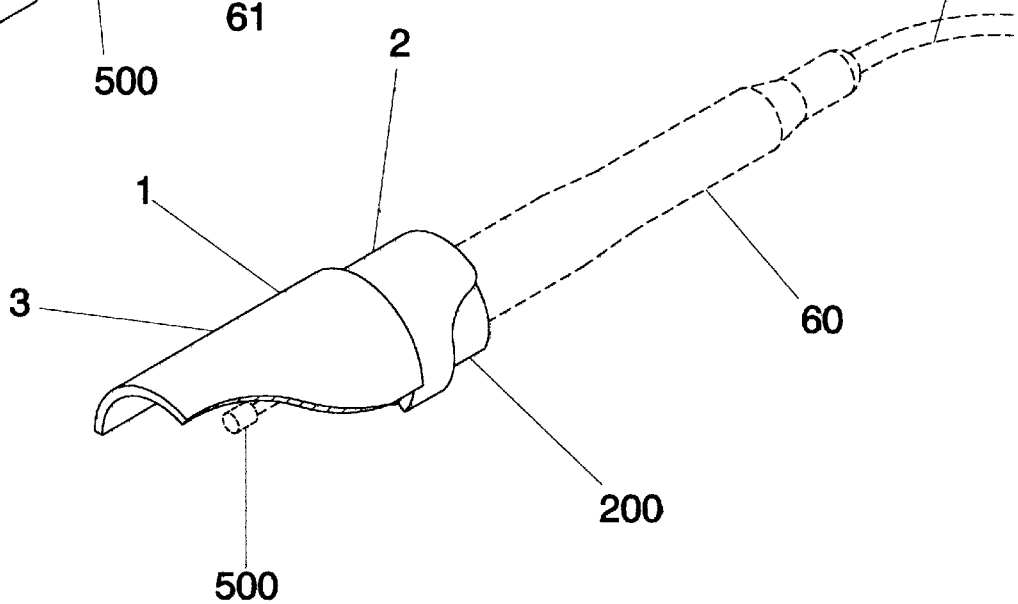
FIG. 9
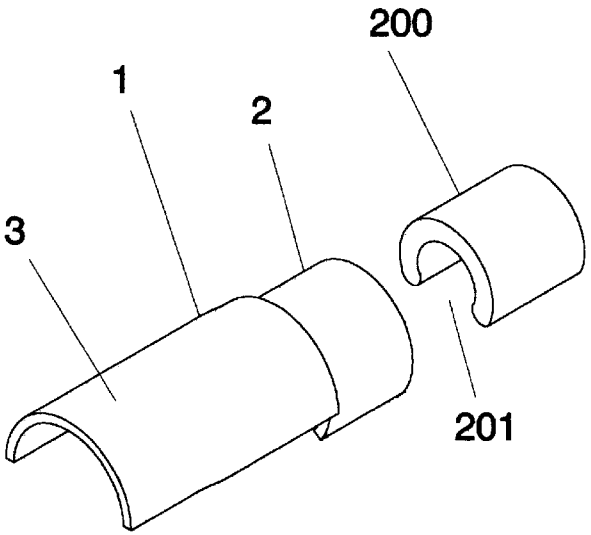

TOOL PROTECTIVE SHIELD

Pursuant to 35 U.S.C. Par. 119(e)(i) applicant claims priority of Provisional Application for Patent No. 60/108,534 of Nov. 16, 1998 for a "Tool Safety Shield".

Statement as to Rights to inventions made under Federally sponsored research and development: Not applicable.

BACKGROUND OF THE INVENTION

1. Field of the Invention

The present invention relates to a protective shield for, but not restricted to, small, hand held, motor driven tools, such as are used for grinding, polishing and cutting.

2. Background Information

Small electric motor driven tools, typically hand held or bench mounted, such as are used for grinding, polishing, and cutting are popular and widely used. These tools are typically light weight, 3600 rpm and higher, and convenient to use. However, at typical speeds of 3,600 rpm and higher, some of the items mounted on the tools, such as abrasive discs tend to shatter. Also, wire brushes tend to throw wires. Also, users of such tools sometimes injure fingers when they inadvertently rest them against a rotating chuck of such tools. Safety is a problem, because there are not currently available an adequate, light weight, and convenient safety shields for such tools.

As will be seen from the subsequent description of the preferred embodiment of the present invention, these, and other shortcomings of the prior art are overcome.

SUMMARY OF THE INVENTION

The present invention, a tool protective shield, in the preferred embodiment comprises a clip with a transparant shield. The clip comprises a clearance and vent ribs. The shield further comprises a vacuum tube. The tool protective shield is attachable to a tool or to an adapter from the tool to the tool safety shield. The shield can be manufacturer either as a one piece unit or as a multi-piece unit.

BRIEF DESCRIPTION OF THE DRAWINGS

FIGS. 1–16, 19, 20 and 22 illustrate various embodiments of the present invention, a tool protective shield, with various adaptors, installed on various tools.

DESCRIPTION OF THE PREFERRED EMBODIMENTS

Figure 1:
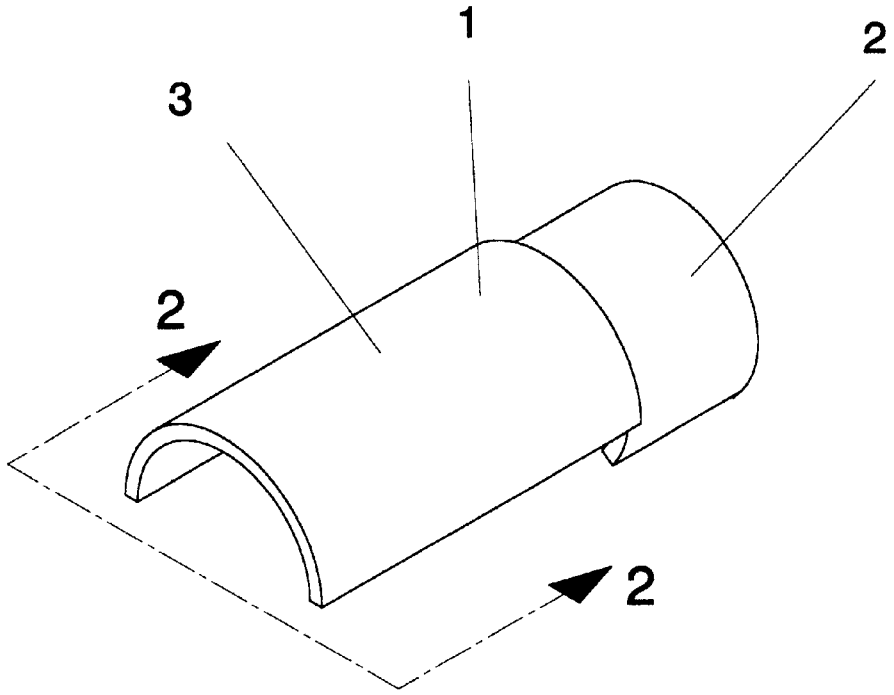
Figure 2:
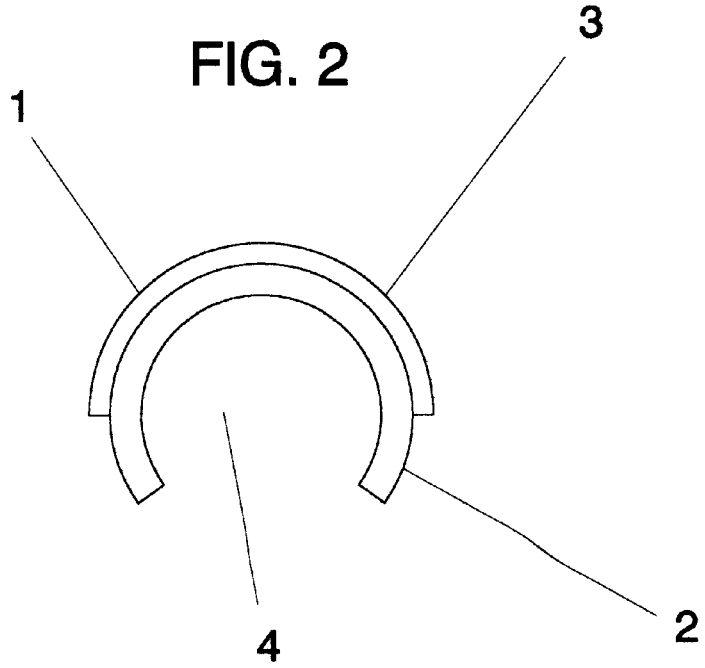

FIGS. 1 and 2 illustrate a first embodiment of the present invention, a basic protective shield assembly 1 comprising a mount clip 2 and a shield 3 wherein said clip 2 is affixed to said shield 3. The shield 3 is a transparant shield with a clearance 4. The clearance 4 permits the clip 2 to clip on to either a tool or a tool adapter.

Figure 4:
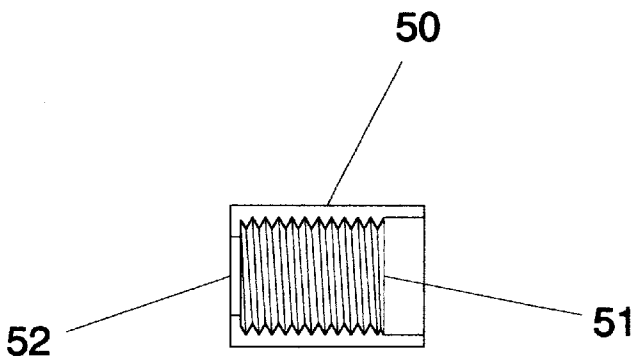

FIG. 4 illustrates a threaded adapter 50 which comprises mounting threads 51 and a chuck clearance 52.

Figure 3:
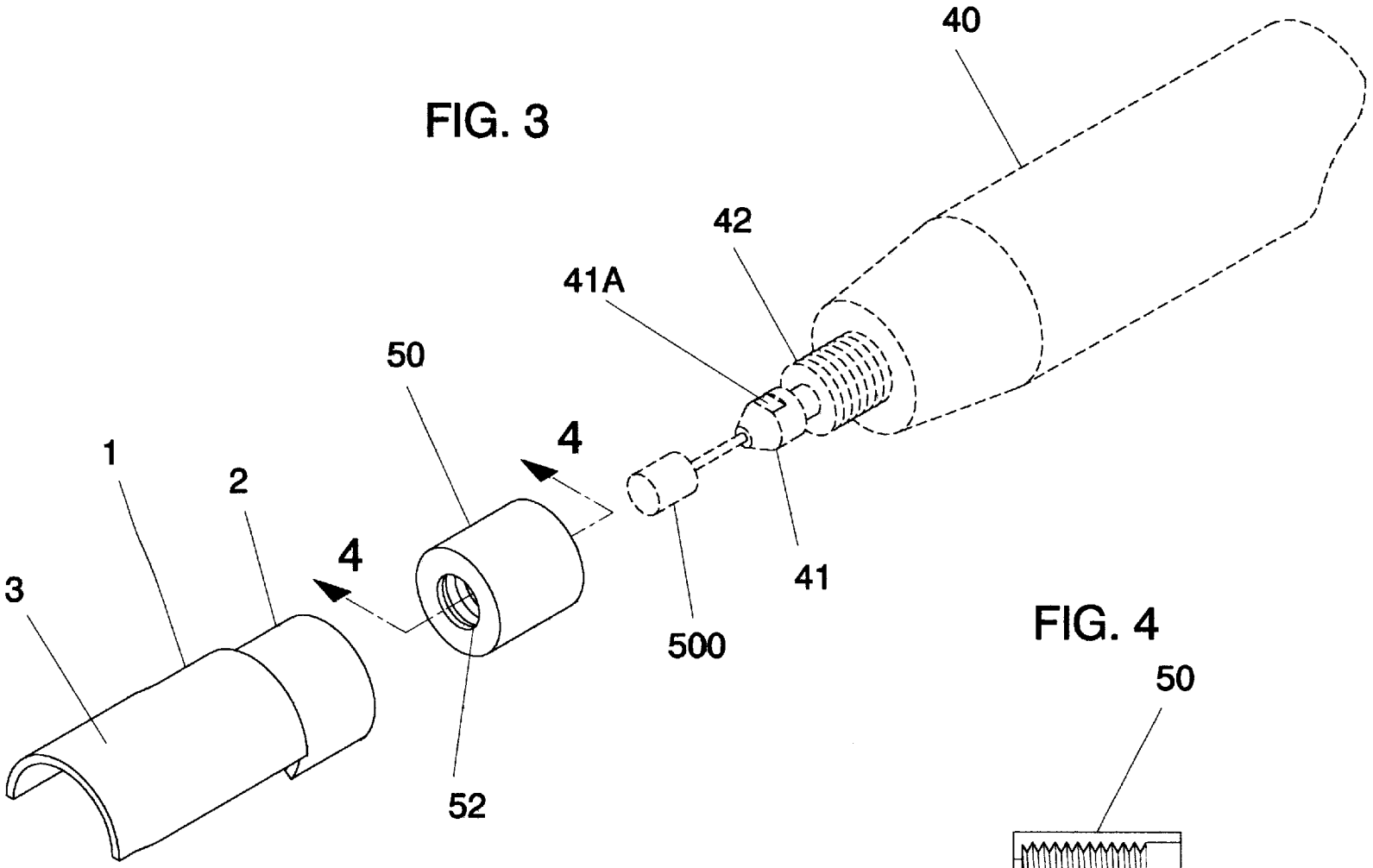
Figures 5, 6:
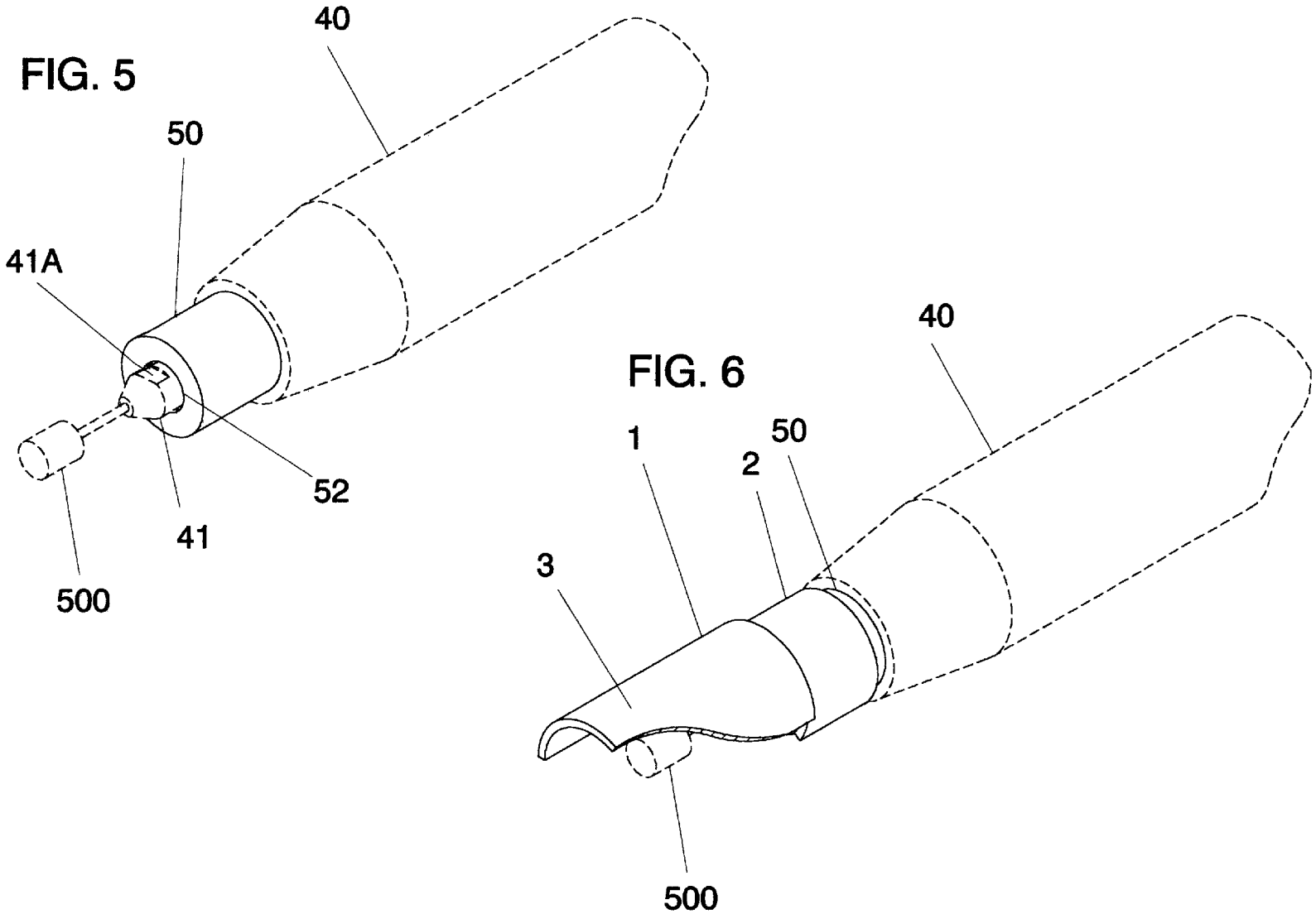

FIGS. 3, 5, and 6 illustrate how the basic protective shield assembly 1 with the mount clip 2 and the shield 3 will mount on the threaded adapter 50 with the chuck clearance 52 which mounts on a prior art electrical hand held grinding tool 40 which comprises a threaded boss 42, a tool chuck 41 with tightening flats 41A with a tool accessory 500 which is a rotating tool accessory 500 during its indended use. Such tools 40 are available and known in the trade under the registered trademark DREMEL. When said shield assembly 1 is installed on said adapter 50 by mounting said clip 2 onto said adapter 50, said shield assembly 1 serves as a guard between the tool accessory 500 and an operator of said tool 40 with said tool accessory 500.

Figures 7, 8:
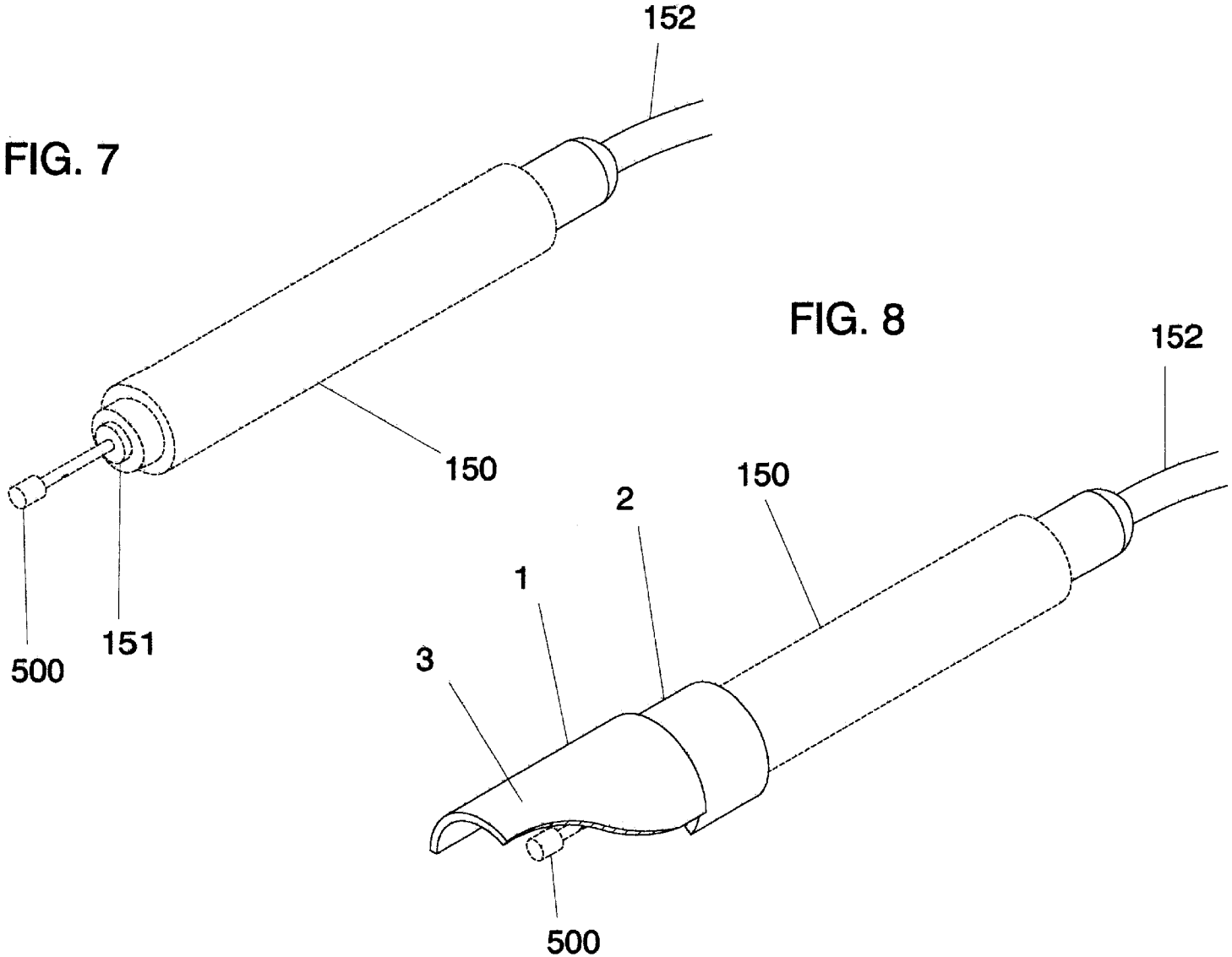

FIG. 7 illustrates a standard prior art hand held flexible shaft driven rotary tool 150 comprising a flexible shaft 152, a common tool chuck 151, with the tool accessory 500. As said tool 150 with said shaft 152 is not threaded, said protective shield assembly 1 with said mount clip 2 and said shield 3 will mount directly on said tool 150 without the threaded adapter 50 which was required for said tool 40 shown in FIGS. 3, 5, and 6. When said shield assembly 1 is installed on said tool 150 by mounting said clip 2 onto said tool 150, said shield assembly 1 serves as a guard between the tool accessory 500 and an operator of said tool 150 with said tool accessory 150. In the preferred embodiment of the present invention, said shield 3 is curvilinear in shape so as to maximize protection of an operator yet permit the accessory tool 500 to achieve its intended purpose, such as, but not limited to, grinding, abrading, polishing, or cutting.

FIGS. 9 and 10 illustrate said shield assembly 1 with said mount clip 2 and said shield 3, a clip-on adaptor 200 with a clip-on clearance 201 and a small hand held flexible shaft driven grinding tool 60 comprising a flexible shaft drive 62, a collet 61, and the rotary wheel 500 and the installation of said shield assembly 1 on said adaptor 200 on said tool 60.

Figure 11:
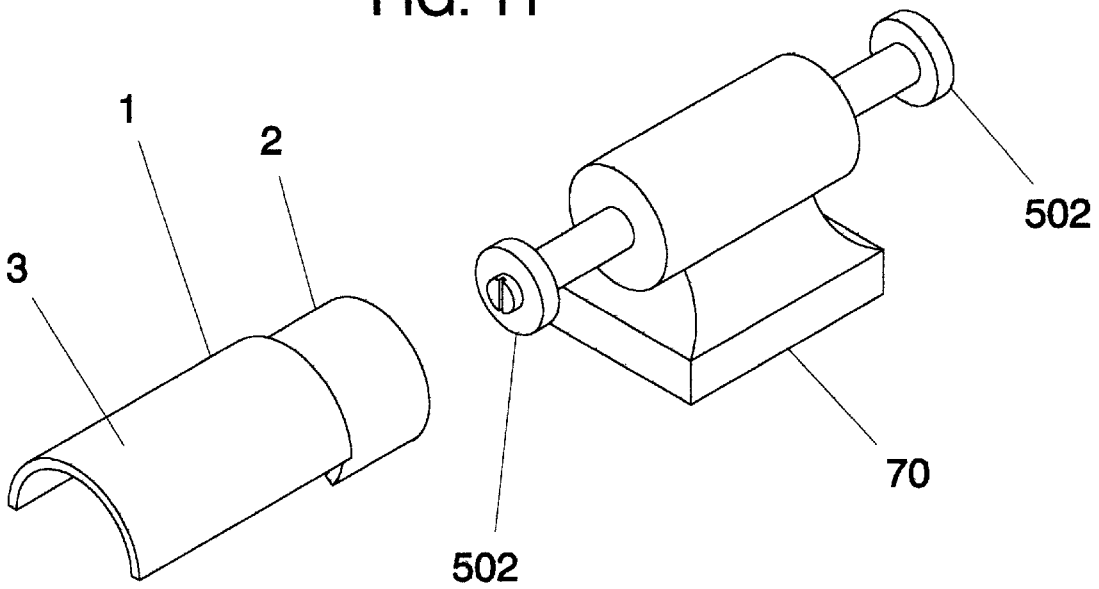
Figure 12:
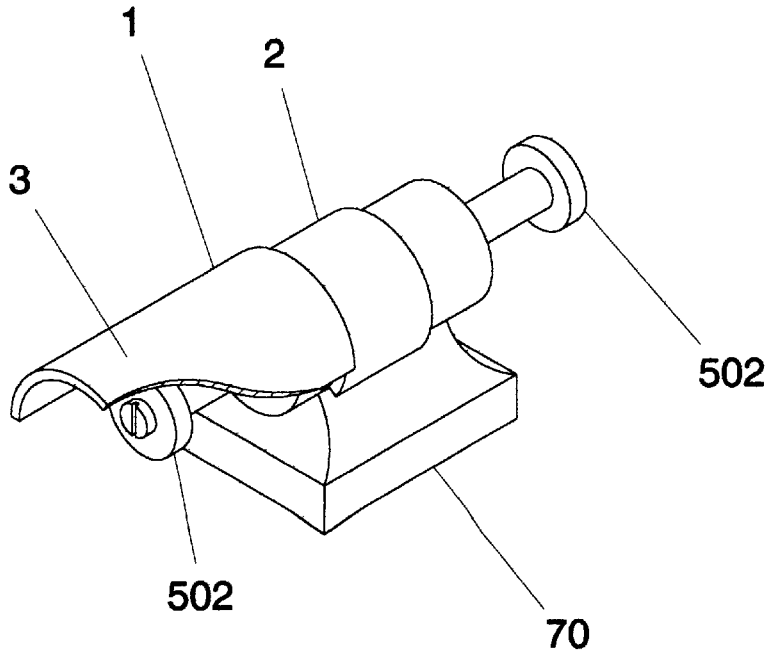

FIGS. 11 and 12 illustrate said shield assembly 1 with said mount clip 2 and said shield 3 with a bench mounted small grinder/polisher 70 with grinder/polisher wheels 502 and how said shield assembly 1 mounts on said grinder/polisher 70.

Figure 13:
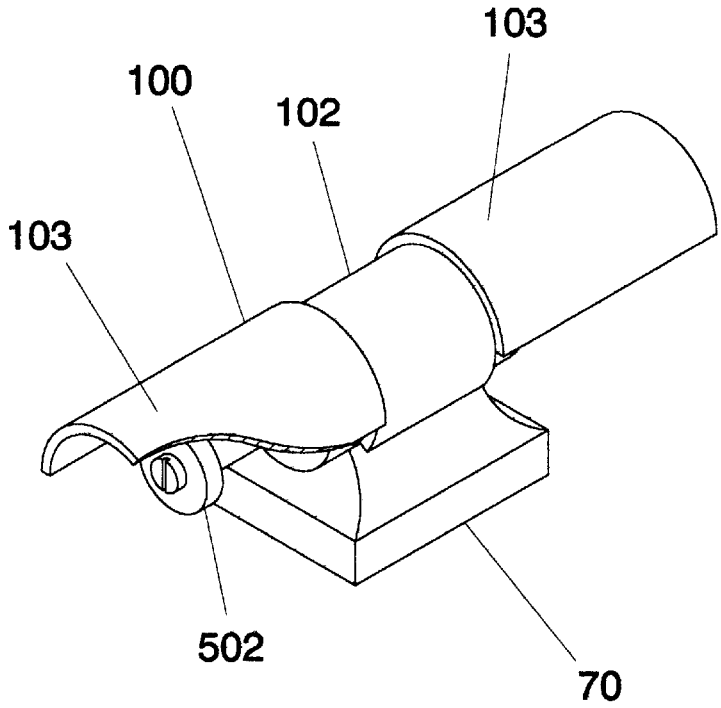

FIG. 13 and illustrates a double shield assembly 100 comprising a motor mount clip 102 and two shields 103 mounted on said grinder/polisher 70 wherein said shields 13 are affixed to said clip 102. The double shield assembly 100 differs from said shield assembly 1 only in that said assembly 100 has two shields 103 as opposed to a single shield 3 as does said assembly 1. Both assemblies 1 and 100 clip onto said grinder/polisher 70 as the repsective clips 2 and 102 of assemblies 1 and 100 are of the same construction as shown for said clip 2 in FIGS. 1 and 2.

Figure 14:
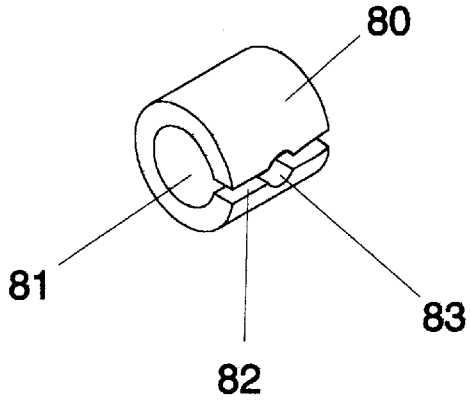

FIG. 14 illustrates a slotted and drilled adapter 80 comprising a slotted and drilled adapter clearance 81, a slot 82 and, a collet tool clearance 83.

Figure 15:
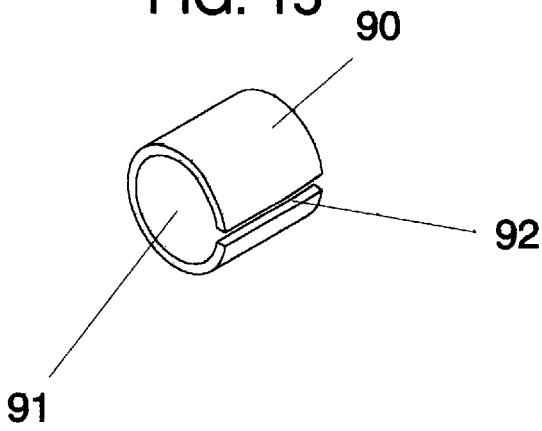

FIG. 15 illustrates a slotted adapter 90 comprising a slotted adapter clearance 91 and a slotted adapter slot 92.

Figure 16:
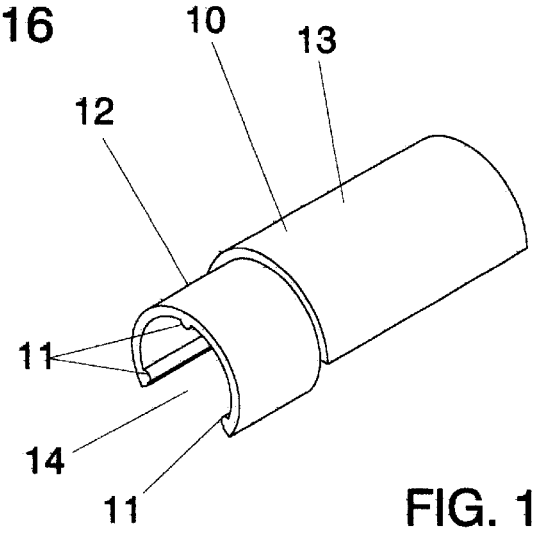

FIG. 16 illustrates a ribbed shield assembly 10 comprising a ribbed shield clearance 14, a ribbed mount clip 12 with vent ribs 11, and a ribbed shield assembly shield 13 wherein said clip 12 is affixed to said shield 13. This is an alternate embodiment to said shield assembly 1 previously discussed. The vent ribs 11 facilitate heat dissipation from a tool, such as said tool 150, by providing for a gap between said clip 12 and said tool 150 to which said shield assembly 10 is applied.

Figure 17:
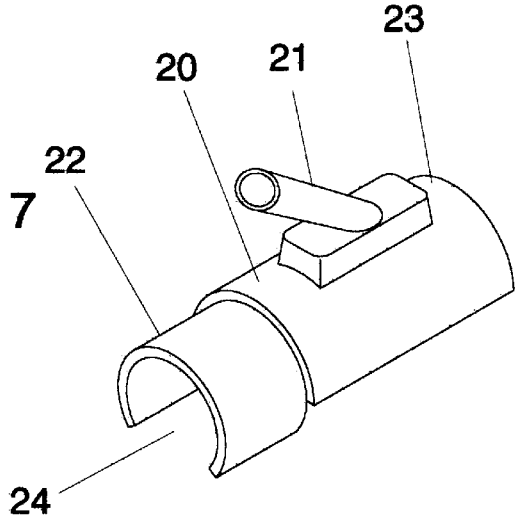
FIGS. 17, 18, and 23 illustrate embodiments of the present invention with a vacuum connection.

FIG. 17 illustrates a vacuum shield assembly 20 comprising a vacuum shield assembly mount clip 22 with a vacuum shield assembly mount clip clearance 24 and a vacuum shield 23 with a vacuum tube 21 wherein said clip 22 and said tube 21 are affixed to said shield 23. The vacuum tube 21 permits connection of a vacuum or air hose for either pulling a vaccum on a work piece or for blowing air over said work piece.

Figure 18:
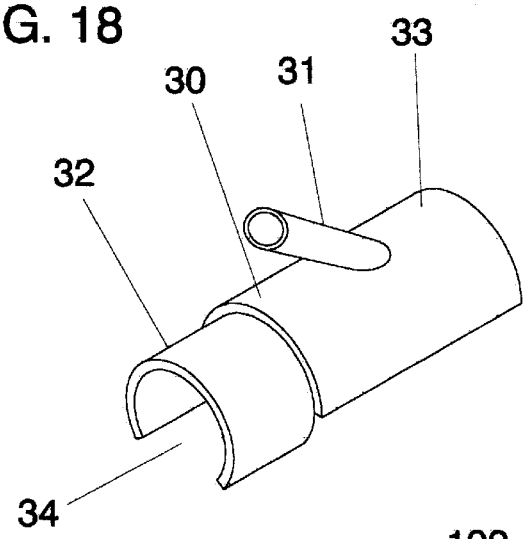

FIG. 18 illustrates an alternate vacuum shield assembly 30 comprising an alternate vacuum shield assembly mount clip 32 with an alternate vacuum shield assembly mount clip clearance 34 and an alternate vacuum shield 33 with an alternate vacuum tube 31 wherein said clip 32 and said tube 31 are affixed to said shield 33.

Figure 19:
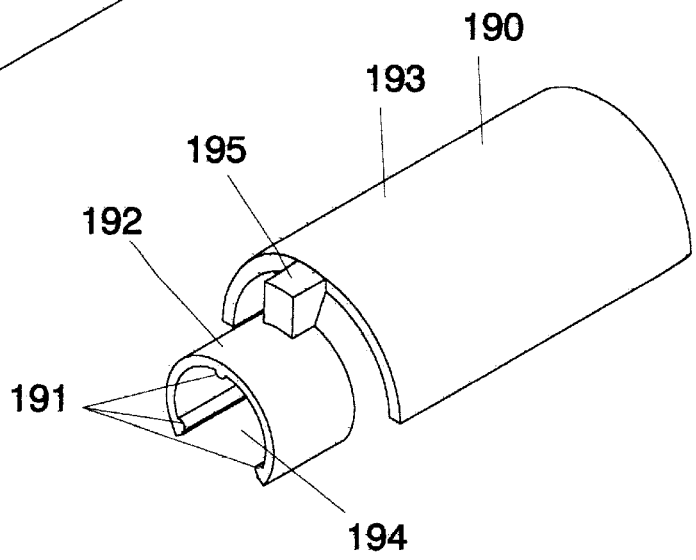

FIG. 19 illustrates an offset ribbed shield assembly 190 comprising an offset ribbed assembly shield 193, an offset ribbed mount clip 192 comprising an offset ribbed mount clip clearance 194 and mount clip ribs 191, and an block 195 which connects said offset ribbed mount clip 192 to said offset ribbed assembly shield 193.

Figure 20:
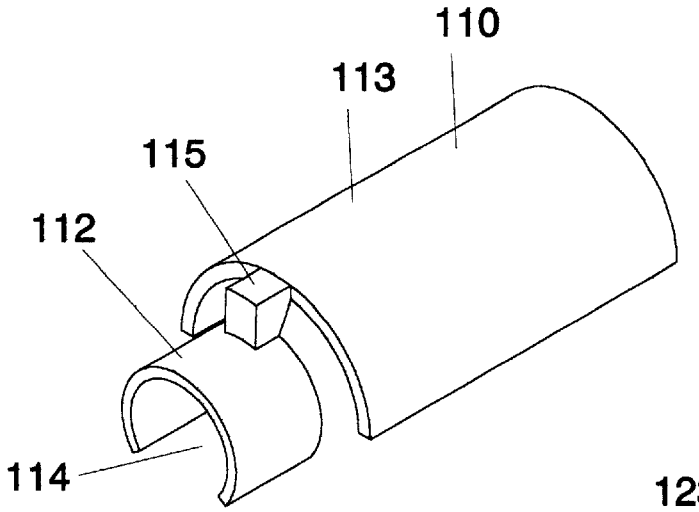

FIG. 20 illustrates an offset shield assembly 110 comprising an offset assembly shield 113, an offset mount clip 112 comprising an offset mount clip clearance 114, and an offset block 115 which connects said said offset assembly shield 113 to said offset mount clip 112.

Figure 21:
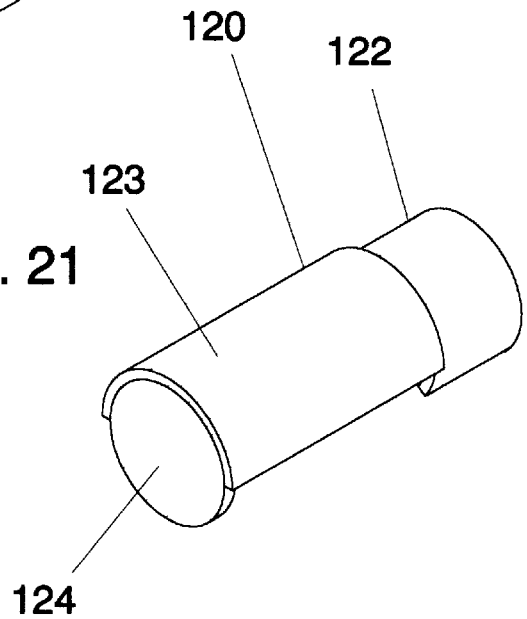

FIG. 21 illustrates a capped shield assembly 120 comprising a circular plane end cap 124, a capped shield 123, and a capped shield assembly mount clip 122 wherein said cap 124 is affixed to said shield 123 which is affixed to said clip 122.

Figure 22:
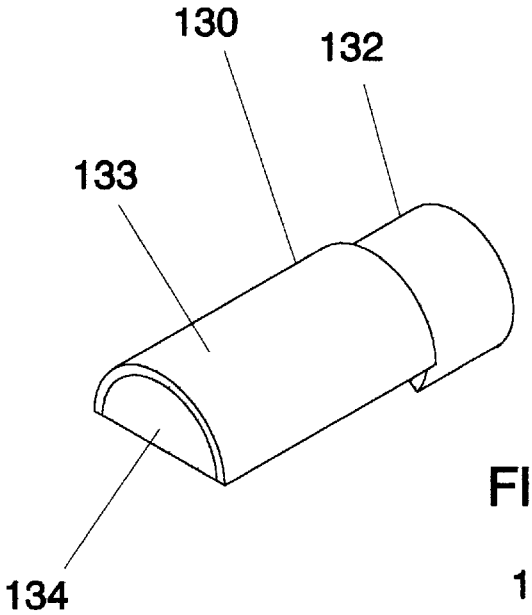

FIG. 22 illustrates a end capped shield assembly 130 comprising a semi-circular plane end cap 134, an end capped shield 133, and an end capped shield assembly mount clip 132 wherein said cap 134 is affixed to said shield 133 which is fixed to said clip 132.

Figure 23:
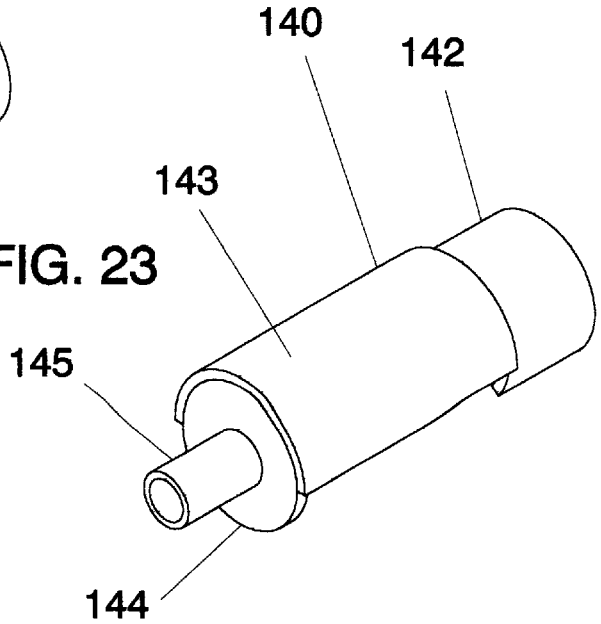

FIG. 23 illustrates an end vacuum shield assembly 140 comprising an end vacuum shield 143, and an end vaccum shield assembly mount clip 142, an annular cap 144, and an end vacuum tube 145, wherein said tube 145 is affixed to said annular cap 144 which is affixed to said shield 143 which is affixed to said clip 142. The purpose of said tube 145 is to permit either a vacuum to be pulled on, or air blown through, said shield assembly 140.

Figure 24:
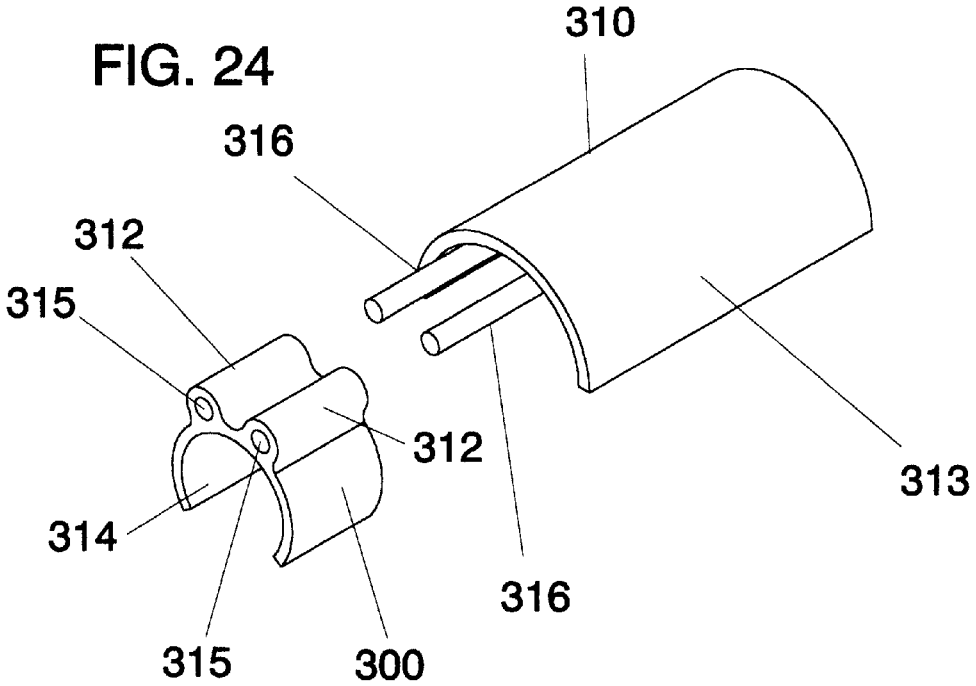
FIGS. 24 through 31 illustrate embodiments of the present invention which feature a two piece tool protective shield.
Figure 25:
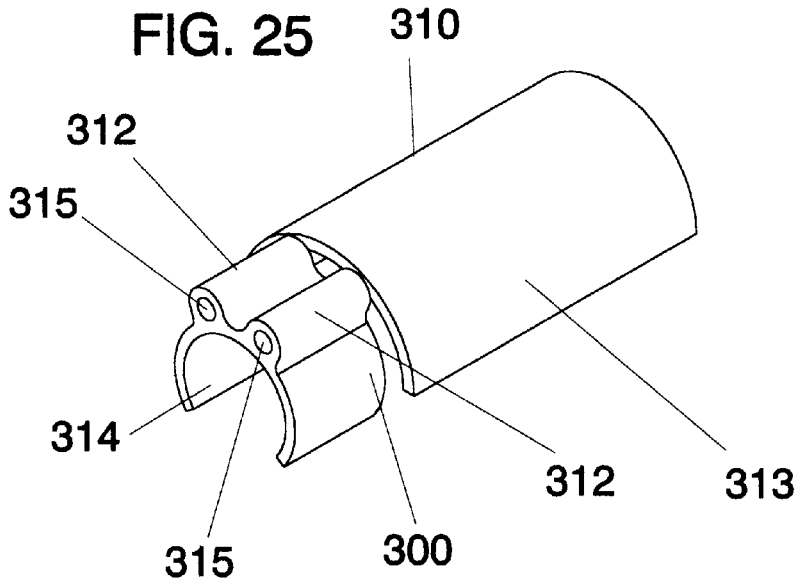

FIG. 24 and 25 illustrate a double projection shield assembly 310 comprising a double projection shield 313 with projections 316 and a receptacle clip 300 comprising projection receptacles 312, each with a receptacle clearance 315, and a receptacle clip clearance 314 wherein the projections 316 mate with and are received by said clearances 315 of said receptacles 312.

Figure 26:
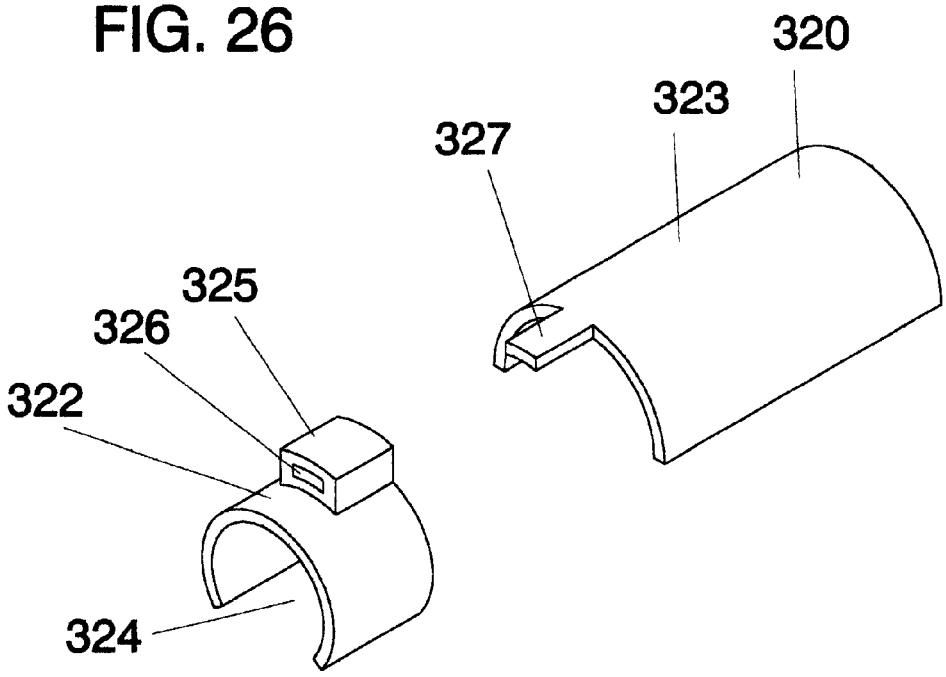
Figure 27:
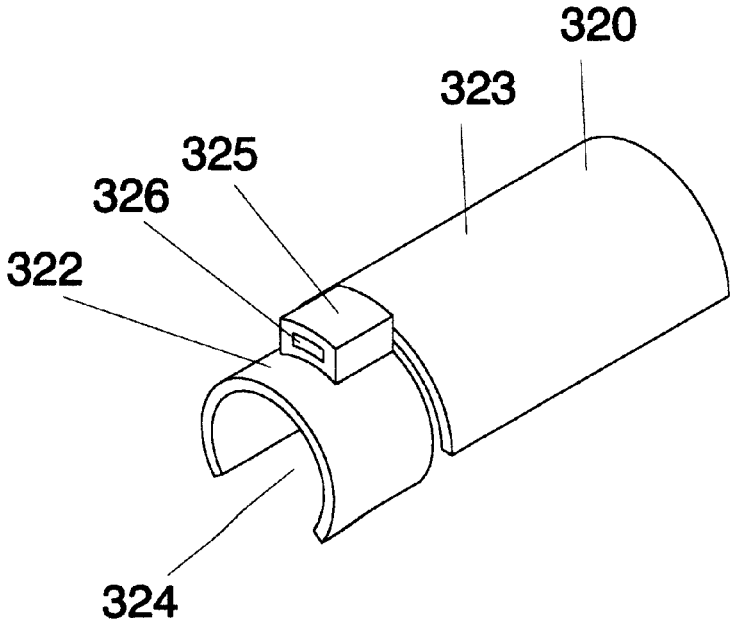

FIGS. 26 and 27 illustrate a singular rectangular projection shield assembly 320 which comprises a projection shield 323 with a singular rectangular projection 327, and a single rectangular projection shield clip 322 comprising a single rectangular protection shield clip clearance 324 and square projection receptacle 325 with a square receptacle clearance 326 wherein said projection 327 mates with and is received by said clearance 326 of said receptacle 325.

Figure 28:
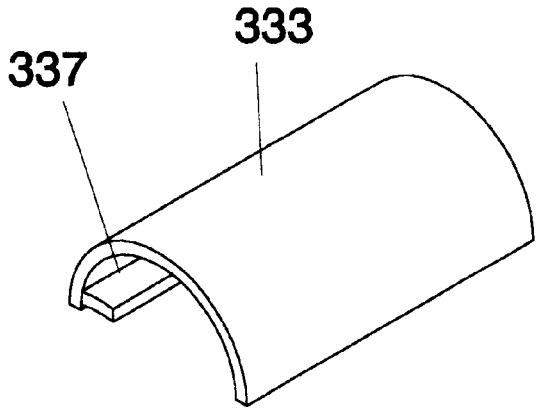
Figure 29:
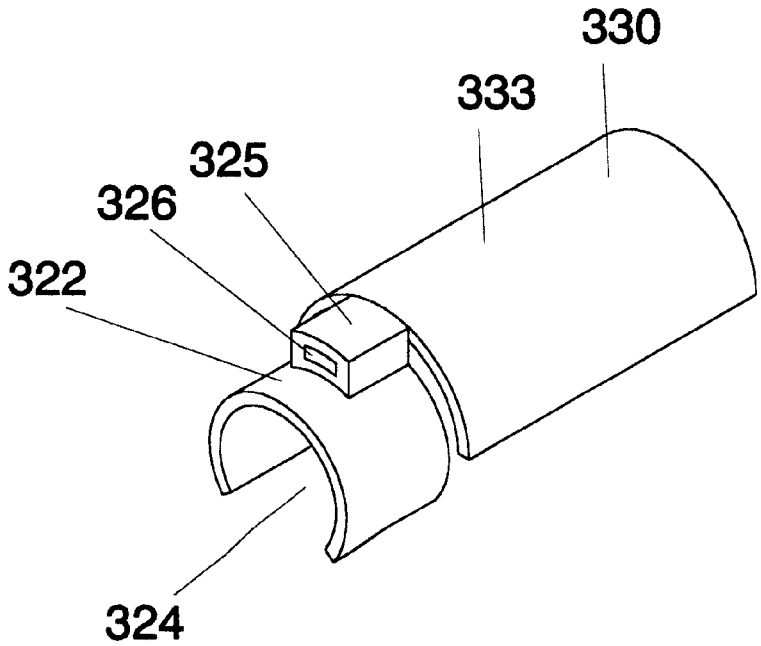

FIGS. 28 and 29 illustrate an offset singular rectangular projection shield assembly 330 which comprises said clip 322 and an offset projection shield 333 with a singular rectangular projection 337 offset so that when said clearance 326 receives said projection 337, said clip 322 is offset from said shield 333.

Figure 30:
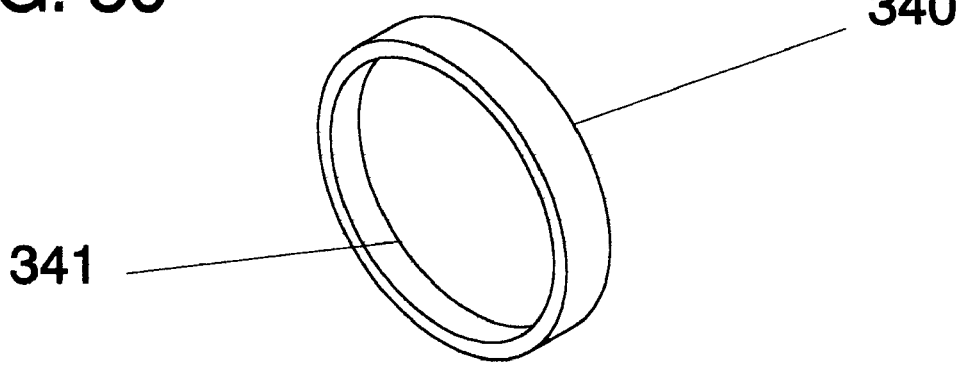
Figure 31:
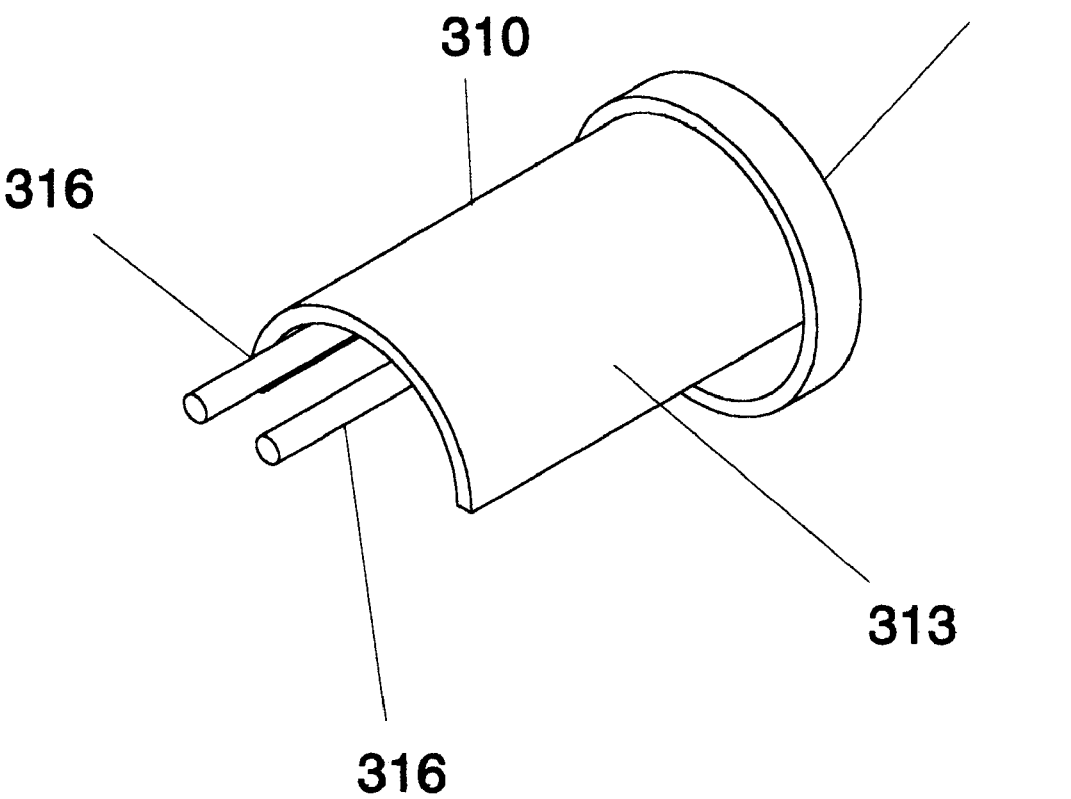

FIG. 30 illustrates an end cap 340 with inner diameter 341 that mates with and accepts said shield 313 with said projections 316 as shown in FIG. 31.

Although the description above contains many specificities, these should not be construed as limiting the scope of the invention but as merely providing illustrations of some of the presently preferred embodiments of the present invention.

A clear structural injection moldable plastic is the preferred material of construction for the various shields discussed. Other parts of the preferred embodiment of the present invention can be plastic or of a metal such as steel or aluminim.

Thus the scope of the invention should be determined by the appended claims and their legal equivalents, rather than by the examples given.

I claim:

1. A tool protective shield assembly comprising;

a clip in the shape of a cylindrical section adapted to fit around a cylindrical tool body;

a tool accessory mounted in said tool body;

a transparent shield connected to said clip;

a plurality of ribs on the inside surface of said clip that separate a portion of the inside surface of the clip from the cylindrical tool body providing a space between said tool body and said clip inside surface.

2. The tool protective shield of claim 1 wherein said tool is a hand held tool and said tool accessory is a rotating bit and said transparent shield acts as a guard between the rotating bit and the operator's hand.

3. The tool protective shield of claim 1 wherein said transparent shield is in the shape of a cylindrical section somewhat larger in diameter than said clip.

4. The tool protective shield of claim 1 wherein said shield includes a tube through which a vacuum can be drawn or air blown.

5. The tool protective shield of claim 1 wherein said clip includes a projection a wherein said shield includes receptacle means which will accept said projection to affix said shield to said clip.

* * * * *